US005297373A

United States Patent [19]

Olsen

[11] Patent Number: 5,297,373

[45] Date of Patent: Mar. 29, 1994

[54] DRAINABLE BLADE LOUVER

[75] Inventor: Robert W. Olsen, Washington, N.J.

[73] Assignee: Construction Specialties, Inc., Cranford, N.J.

[21] Appl. No.: 56,258

[22] Filed: Apr. 30, 1993

[51] Int. Cl.[5] ..... E06B 7/08

[52] U.S. Cl. ..... 52/473

[58] Field of Search ..... 52/473

[56] References Cited

U.S. PATENT DOCUMENTS 3,287,870 11/1966 Johnson ..... 52/473

3,782,050 1/1974 Dowdell et al. ..... 52/473

4,064,670 12/1977 Lichtenwald ..... 52/473

*Primary Examiner*—James L. Ridgill, Jr.

*Attorney, Agent, or Firm*—Brumbaugh, Graves, Donohue & Raymond

[57] ABSTRACT

A drainable blade louver comprises a multiplicity of inclined blades extending horizontally between the jambs of a frame. Each blade has in cross-section a base portion sloping smoothly upwardly from a lowermost point at the front edge of the blade to an uppermost point proximate to the rear edge of the blade. The undersurface of the base portion is free of protuberances so that there are no drip points and water clinging to the undersurface of the base portion is transported along the undersurface by the air flowing through the louver. A generally C-shaped bottom trough portion adjacent the upper edge of the blade captures water blown along the undersurface of the blade and drains it to the jambs. A front drainage trough, an intermediate drainage trough, and a rear drainage trough on the top surface of each blade provide high capacity water-capturing ability. Water captured in each drainage trough is flows along each trough to respective front, intermediate and rear drainage channels in the jambs.

13 Claims, 3 Drawing Sheets

DRAINABLE BLADE LOUVER

BACKGROUND OF THE INVENTION

It is often desirable to minimize the intrusion of water through a louver. In such cases, the use of a drainable-blade louver, many forms of which are available commercially, is called for. Common to almost all drainable blade louvers is the provision of troughs on the front edges of the upper surfaces of the blades for capturing water that would otherwise run down the blades and fall from the front edges onto the blades below. In so doing, some of the water dripping from the front edges of the blades may become entrained in the air flow and carry through the louver. The troughs capture the water and drain it to vertical drainage channels in the jambs of the blade frames. Some drainable louvers have offsets in the blades to stop water from being blown up the blade surfaces and off the upper, rear edges. Other drainable blade louvers, such as the one described and shown in U. S. Pat. No. 4,103,468 (Olsen, Aug. 1, 1978), have additional troughs intermediate the front and rear edges of the blades and an upper rear flange for capturing water from splash and water blown up the blade surfaces. At least one commercially available drainable blade louver, which is of the sightproof type with inverted V-shaped blades, has troughs on the bottom sides of the rear edges of the blades to catch water carried by centrifugal force of the air flow onto the undersides of the back portions of the blades.

Windblown rain enters the front of a louver and impinges on the blades with considerable force. Water drops that strike the blades splash into small droplets, some of which become entrained in the airflow and some of which are carried up, either by their momentum or by rising turbulent air currents, and wet the underside of the blade above. Some of the droplets fall back onto the blade surface. Droplets that are captured by the blade surfaces and collect on the blade surfaces tend to coalesce into a layer of water. The air flow tends to push the water layer formed from the droplets up the blade surfaces.

Previously known drainable blade louvers vary in their effectiveness in preventing water intrusion (carry-through). Most drainable blade louvers, for example, make no provision for capturing water caught on the undersurfaces of the blades. Many lack sufficient drainage trough capacity to drain off all water captured by the troughs in heavy storm conditions, and the troughs overflow. Previously known drainable blade louvers also make no provision for promoting the formation of large, heavy drops from droplets that collect of some surfaces, and the droplets on such surfaces are prone to being picked up and entrained in the air flow.

SUMMARY OF THE INVENTION

An object of the present invention is to provide a drainable blade louver that provides for capturing and draining off to the jambs of the louver frame water blown along the undersurfaces of the blades. Another object is to provide a drainable blade louver that has a large drainage capacity in the form of several troughs, each of which captures water and drains it off to the jambs. Yet another object is to provide surfaces on the blade directly exposed to the airflow that promote the formation of large heavy drops and drip points arranged to release the drops onto the blade surface near or into a trough.

The foregoing objects are attained, in accordance with the present invention, by a drainable blade louver comprising a peripheral rectangular frame having spaced-apart vertical jambs, a sill and a header and a multiplicity of inclined blades extending horizontally between the jambs. Each blade has in cross-section a base portion sloping smoothly upwardly from a lowermost point at the front edge of the blade to an uppermost point proximate to the rear edge of the blade. The undersurface of the base portion is free of protuberances so that there are no drip points and water clinging to the undersurface of the base portion is transported along the undersurface by the air flowing through the louver. A generally C-shaped bottom through portion is provided adjacent the upper edge of the blade, the bottom trough portion having an upper arm joined to the base portion at a smoothly curved juncture, being oriented with its opening facing toward the front of the louver, and having a lower arm forming a trough for capturing water blown along the undersurface of the blade and draining it toward the jambs. A front flange portion extends upwardly from the lower front edge of the base portion and defines with an adjacent part of the base portion a top front trough for capturing water and draining it toward the jambs. At least one rib portion extends upwardly from the base portion intermediate the front and rear edges of the blade and defines a top intermediate trough for capturing water and draining it toward the jambs.

Preferred embodiments of the invention include one or more of the following features, alone or in combination.

A rear flange portion extends upwardly from the rear edge of the blade, is joined to the lower arm of the bottom trough portion, and defines with part of the bottom trough portion a top upper trough for capturing water and draining it toward the jambs.

The rear flange portion has a curved hook part at its upper edge that is curved smoothly forwardly and downwardly to establish a drip point in front of and below the uppermost extremity of the rear flange portion.

Each of the rib portions has a curved hook part at its upper edge that is curved smoothly forwardly and downwardly to establish a drip point in front of and below the uppermost extremity of the rib portion.

The front flange portion has a curved hook part at its upper edge that is curved smoothly rearwardly and downwardly to establish a drip point behind and below the uppermost extremity of the front flange portion.

A front hook-like screw boss extends above the base portion between the front flange portion and the top intermediate trough and a rear hook-like screw boss extends above the base portion between the rear flange portion and the top intermediate trough.

The rear screw boss is located at the juncture between the base portion and the upper arm of the bottom trough portion.

The screw boss portions curve forwardly and downwardly so as to aid in catching water blown along the upper surface of the blade by the air flow through the louver and to form drip points in front of and below the upper extremities of the screw bosses.

Each jamb includes a front vertical drainage channel registering with the ends of the top front troughs of the blades, an intermediate vertical drainage channel registering with the ends of the top intermediate troughs of the blades, and a rear vertical drainage channel registering the bottom drainage troughs of the blades and also with the top rear drainage troughs when they are included.

The rib portion nearer the rear edge of the blade defines with a part of the base portion rearwardly of it a second intermediate drainage trough for capturing water and draining it toward the jambs, and wherein the intermediate drainage channels of the jams register with the second intermediate drainage troughs of the blades.

The drainage channels of each jamb are arranged symmetrically with respect to the axial centerline of the jamb so that the jambs may be reversed front to back and still be positioned in register with the blade drainage troughs.

According to another aspect of the present invention, a composite louver is composed of one or more louvers placed behind a front louver. The drainage channels of each jamb of each louver are arranged symmetrically with respect to the axial centerline of the jamb. The jambs of the back louver are reversed front to back relative to the jams of the front louver. The front flange portion of each blade of each louver behind the front louver is shaped to match and mate with the rear flange portion of the louver in front of it with the uppermost surfaces of the mating flange portions substantially flush.

The fact that the blades slope upwardly from front to back minimizes turbulence in the air flow through the louver and, therefore, minimizes the pressure drop across the louver. The lack of protuberances or surface irregularities on the bottom surface of the blade means that there are no drip points, and water clinging to the underside of the blades is transported by high velocity air flow in strong winds along the underside of the blade to the bottom drainage trough potion at the upper, back edge of the blade. The drainage trough on the upper surface of the blade increases the drainage capacity of the blade. The elements that project up from the top surface of the blade to form the troughs have wide surfaces that curve in a desired direction to establish drip points for relatively large and heavy drops that coalesce on them from droplets. The larger drops that form on those surfaces are less likely to become entrained in the air flow than are smaller drops that form on narrower surfaces.

For a better understanding of the invention, reference may be made to the following description of an exemplary embodiment, taken in conjunction with the accompanying drawings.

DESCRIPTION OF THE EMBODIMENT

Figure 1:
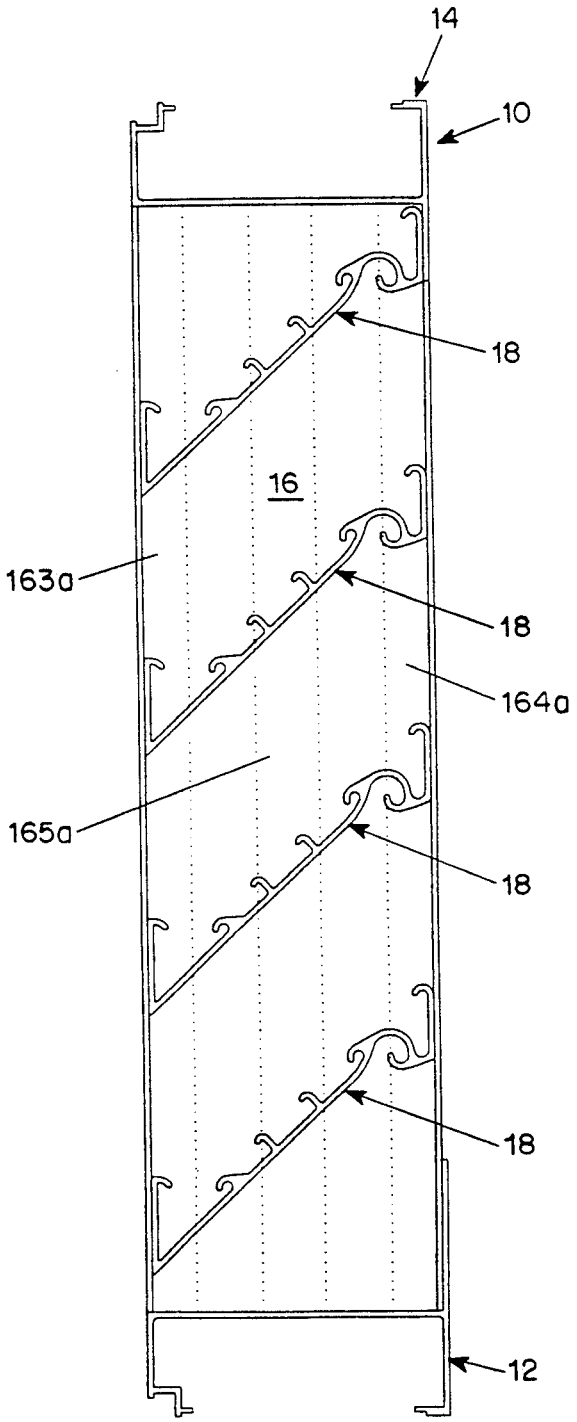
FIG. 1 is an end view of the embodiment in which the jamb at the end being viewed has been removed.
Figure 2:
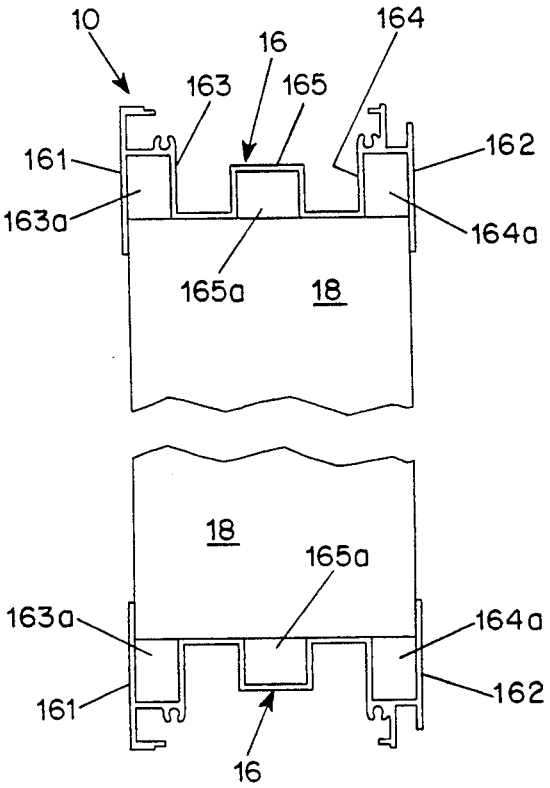
FIG. 2 is a top plan view of the embodiment in which the header of the frame has been removed, the blades partly cut away, and the details of the blade omitted.
Figure 3:
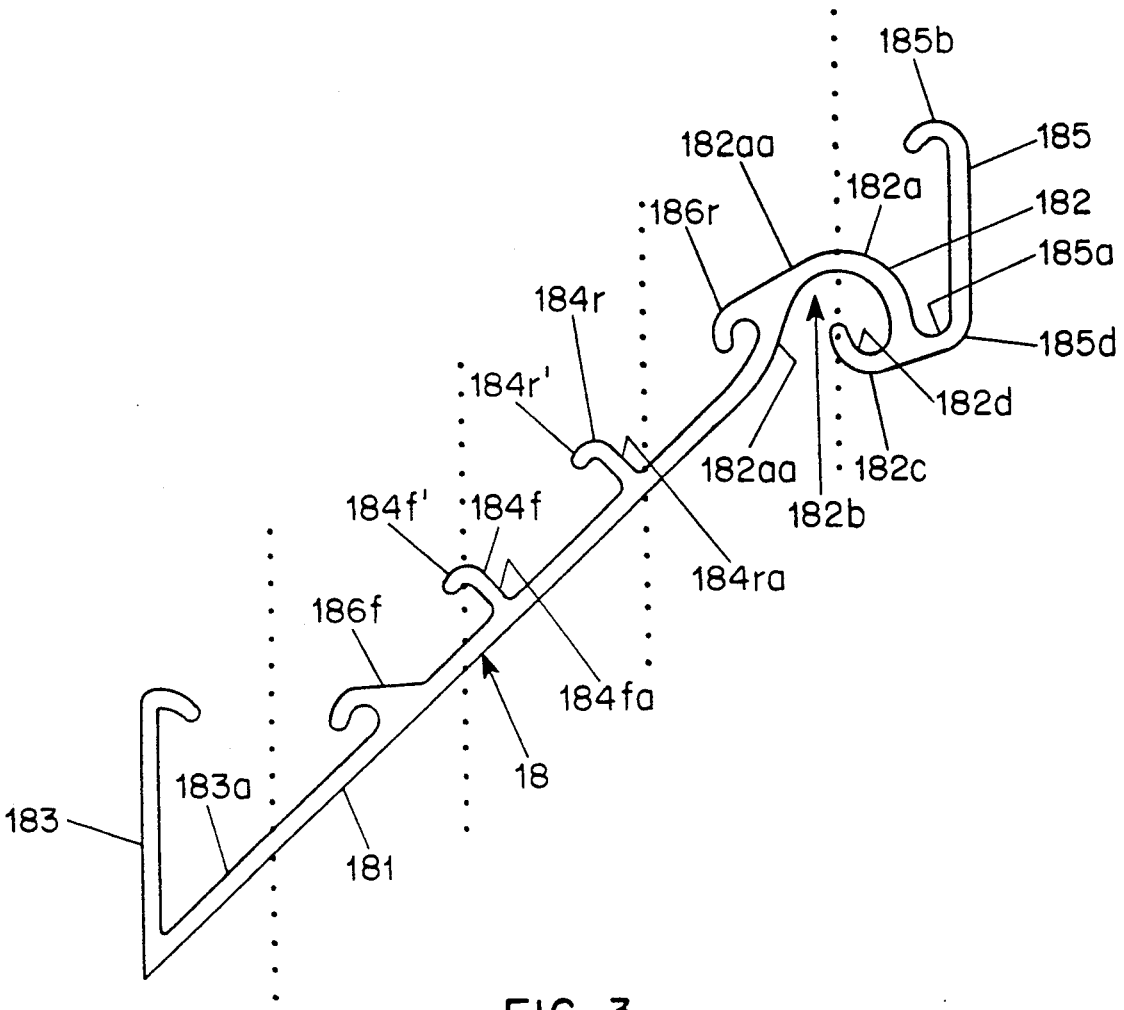
FIG. 3 is an end view of a typical blade of the embodiment.

Referring to FIGS. 1 to 3, the louver comprises a rectangular frame 10, which is composed of a sill 12, a header 14 and two jambs 16, and a multiplicity of equally spaced apart, horizontal blades 18 extending between and fastened to the jambs. The blades 18 of the embodiment are identical, but it is envisioned that blades of shapes differing from each other may be provided. Each blade is of uniform cross-section along its length. FIG. 1 shows a louver with four blades, but in practice there will almost always be many more blades. The blades are, preferably, pieces cut from an extrusion of a suitable material, such as aluminum. Each blade 18 has in cross-section a base portion 181 that slopes smoothly upwardly from a lowermost point at the front edge of the blade, which is to the left in FIGS. 1 and 3, to an uppermost point proximate to the rear edge of the blade. In the illustrated embodiment, the base portion 181 is planar, but it may be smoothly curved or have both planar and curved portions.

The undersurface of the base portion 181 of each blade is free of protuberances, edges or abrupt changes in shape so that there are no drip points and water clinging to the undersurface of the base portion can be driven along the undersurface by the air flowing through the louver. In heavy wind-driven rains, droplets striking the tops of the blades produce splash, and some droplets from the splashes cling to the undersurface of the blade above. The droplets driven upwardly and rearwardly along the undersurface of the base portion 181 are captured in a generally C-shaped bottom trough portion 182 located adjacent the upper back edge of the blade. The bottom trough portion 182 has an upper arm **182*a* joined to the base portion 181 at a smoothly curved juncture 182*aa*, is oriented with its opening 182*b* facing toward the front of the louver, and has a lower arm 182*c* forming a trough 182*d* for capturing water blown along the undersurface of the blade and draining it toward the jambs 16**.

A front flange portion 183 extends vertically upwardly from lower front edge of the base portion 181 and defines with an adjacent part of the base portion 181 a top front trough **183*a* for capturing water and draining it toward the jambs. A pair of spaced-apart rib portions 184*f*, 184*r* extend upwardly from the base portion intermediate the front and rear edges of the blade and define two top intermediate drainage troughs 184*fa* and 184*ra* for capturing water and draining it toward the jambs. A rear flange portion 185 extends upwardly from the rear edge of the blade, is joined to the lower arm 182*c* of the bottom trough portion, and defines with part of the bottom trough portion a top back trough 185*a* for capturing water and draining it toward the jambs. The top back trough 185*a* is preferred, but not essential. The juncture 185*d* between the rear flange portion 185 and the bottom trough portion 182 is radiussed so that any water drops that reach the juncture 185*d* will cling to the underside of the bottom trough portion 182, flow along it toward the front of the louver and drip further upstream from the lowest point of the part 182*c***.

The rear flange portion 185 has a curved hook part **185*b* at its upper edge that is curved smoothly forwardly and downwardly to establish a drip point at its tip in front of and below the uppermost extremity of the rear flange portion. Similarly, each of the rib portions 184*f* and 184*r* has a curved hook part 184*f*, and 184*r*, at its upper edge that is curved smoothly forwardly and downwardly to establish a drip point at its tip, which like the hook part 185***b*, is located in front of and below the uppermost extremity of the respective rib portion. Also in a like manner, the front flange portion 183 has a curved hook part at its upper edge that is curved smoothly downwardly, but in this case rearwardly, to establish a drip point behind and below the uppermost extremity of the front flange portion. Droplets that fall onto the hook portions tend to coalesce into large heavy drops, which fall by their weight from the tips of the hook parts. The hook parts are intentionally made to have relatively large areas to promote formation of large drops. The drops falling from those drip points are collected in the adjacent troughs.

A front hook-like screw boss 186*f* extends above the base portion between the front flange portion 183 and the front top intermediate trough 184*fa*, and a rear hook-like screw boss 186*r* extends above the base portion between the rear flange portion 185 and the top intermediate trough 184*ra* at the juncture 182*aa* between the base portion and the upper arm 182*a* of the bottom trough portion 182. The main function of the screw bosses is, of course, to receive screws (not shown) that pass through holes in the jambs and by which the blades are fastened to the jambs. The screw boss portions curve forwardly and downwardly and serve the additional function of catching water blown along the upper surface of the blade by the air flow through the louver. The tips of the screw boss portions form drip points in front of and below the upper extremities of the screw bosses.

Each jamb 16 (see FIG. 2) includes front and rear face flange portions 161 and 162, respectively, that partially overlap the front and rear edges of the blades and front and rear L-shaped portions 163 and 164 that define with adjacent portions of the flanges 161 and 162 a front vertical drainage channel 163*a* and a rear vertical drainage channel 164*a*. The front drainage channels 163*a* register with the ends of the top front troughs 183*a* of the blades, and the rear drainage channel 164*a* registers with the rear top drainage trough 185*a* and the bottom drainage trough 182*d* of each blade. An intermediate vertical drainage channel 165*a* is defined by a U-shaped portion of each jamb 16 and registers with the ends of the top intermediate troughs 184*a* of the blades. The rear rib portion 184*r* nearer the rear edge of the blade defines with a part of the base portion rearwardly of it a second top intermediate drainage trough 184*ra* for capturing water and draining it toward the jambs, the intermediate drainage channels of the jambs registering with the second intermediate drainage troughs of the blades. The edges of the drainage channels are shown by the dotted lines in FIG. 1. The bottom troughs 182*d* collect water droplets that cling to the undersides of the blades and are blown upwardly along the blades by the air flow. Accordingly, those droplets are not blow off the back edges of the blades.

By capturing water in several top troughs, each blade has the ability to handle a large amount of water. The water captured in each trough drains to the ends of the blades and empties into the respective drainage channels. The water received in the channels from the blades flows down the channels to the bottom of the louver and is discharged in a suitable manner. The provision of multiple channels also contributes to the ability of the louver to handle large amounts of water, in that the total amount of water collected by and drained from the blades is divided among the multiple channels.

Figure 4:
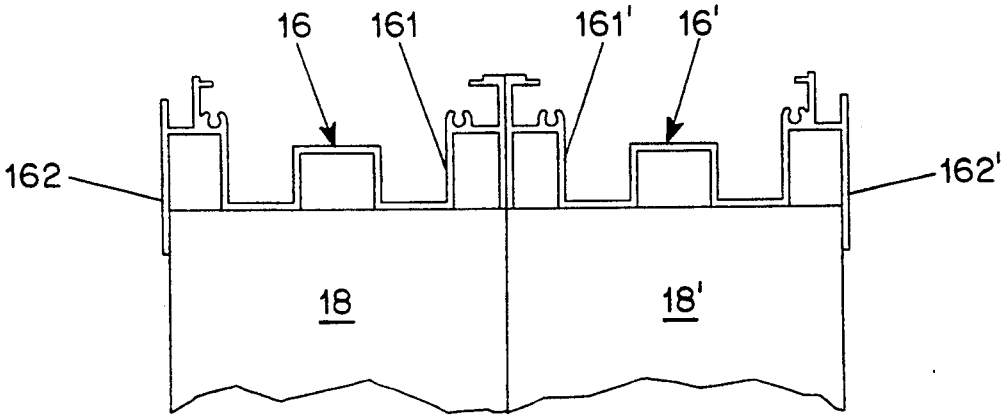
FIG. 4 is a partial top view, again with the header removed and the blade details omitted, showing the combining of two louvers front to back to make a deeper composite louver.
Figure 5:
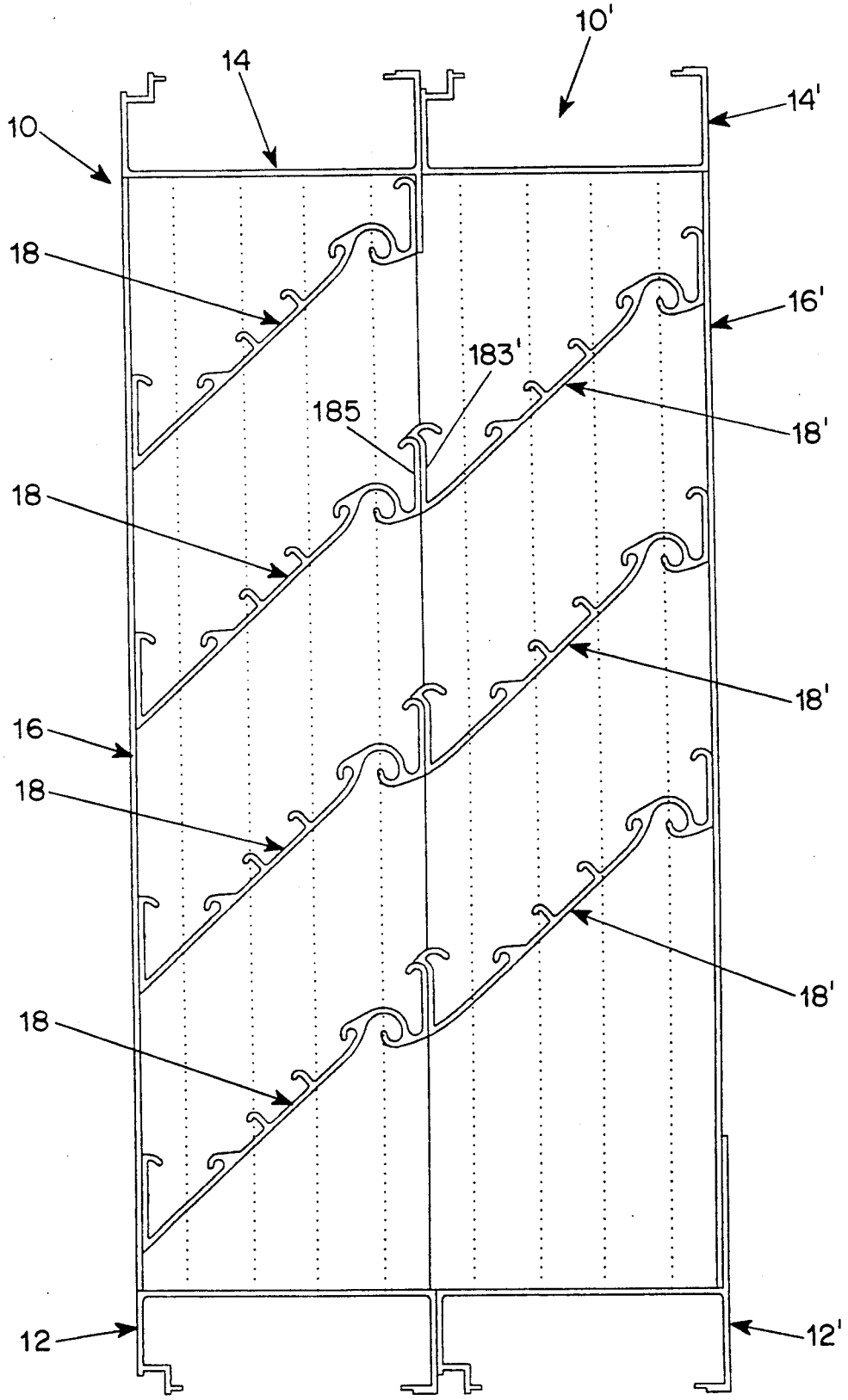
FIG. 5 is an end view of the louver shown in FIG. 4 with the near jamb of the frame omitted.

It will be observed from examination of the drawings that the drainage channels of the jambs are symmetrically placed with respect to the axial centerline of the jamb 16 and that the front and rear drainage channels 163*a* and 164*a* are of the same width. That configuration permits two louver units 10 and 10' to be placed front to back, as shown in FIGS. 4 and 5, to form a composite louver having twice the depth of the single unit louver shown in FIGS. 1 to 3. The jambs 16 of the rear louver 10' are reversed front to back, relative to those of the front unit. The header 14 and sill 12 are fastened to the jambs by screws (not shown) received in screw bosses 166, which are also symmetrically located with respect to the axial centerline. A composite louver made from three single louver units can also be made with minor changes in the jambs, sill and header of the center unit.

In louvers composed of multiple units of the form shown in FIGS. 1 to 3, the blades 18, of units (e.g. 10') placed in back of the front unit 10 are modified by forming the front flange portions 183' so that they mate with the rear flange portions 185 of the front unit 10 and present top surfaces that are flush with the tops of the flange portions 185 of the front unit (see FIG. 5).

I claim:

1. A drainable blade louver comprising a peripheral rectangular frame having spaced-apart vertical jambs, a sill and a header, and a multiplicity of inclined blades extending horizontally between the jambs, each blade having in cross-section a base portion sloping smoothly upwardly from a lowermost point at the front edge of the blade to an uppermost point proximate to the rear edge of the blade, the undersurface of the base portion being free of protuberances so that there are no drip points and water clinging to the undersurface of the base portion is transported along the undersurface by the air flowing through the louver, a generally C-shaped bottom trough portion adjacent the upper edge of the blade, the bottom trough portion having an upper arm joined to the base portion at a smoothly curved juncture, being oriented with its opening facing toward the front of the louver, and having a lower arm forming a trough for capturing water blown along the undersurface of the blade and draining it toward the jambs, a front flange portion extending upwardly from lower front edge of the base portion and defining with an adjacent part of the base portion a top front trough for capturing water and draining it toward the jambs, and at least one rib portion extending upwardly from the base portion intermediate the front and rear edges of the blade and defining a top intermediate trough for capturing water and draining it toward the jambs.

2. A drainable blade louver according to claim 1 wherein the rib portion has a curved hook part at its upper edge that is curved smoothly forwardly and downwardly to establish a drip point in front of and below the uppermost extremity of the rib portion.

3. A drainable blade louver according to claim 1 wherein the front flange portion has a curved hook part at its upper edge that is curved smoothly rearwardly and downwardly to establish a drip point behind and below the uppermost extremity of the front flange portion.

4. A drainable blade louver according to claim 1 wherein each blade further includes in cross-section a rear flange portion extending upwardly from the rear edge of the blade, joined to the lower arm of the bottom trough portion, and defining with part of the bottom trough portion a top upper trough for capturing water and draining it toward the jambs.

5. A drainable blade louver according to claim 4 wherein the rear flange portion has a curved hook part at its upper edge that is curved smoothly forwardly and downwardly to establish a drip point in front of and below the uppermost extremity of the rear flange portion.

6. A drainable blade louver according to claim 1 wherein each blade further includes in cross-section a front hook-like screw boss extending above the base portion between the front flange portion and the top intermediate trough and a rear hook-like screw boss extending above the base portion between the rear flange portion and the top intermediate trough.

7. A drainable blade louver according to claim 6 wherein the rear screw boss is located at the juncture between the base portion and the upper arm of the bottom trough portion.

8. A drainable blade louver according to claim 6 wherein the screw boss portions curve forwardly and downwardly so as to aid in catching water blown along the upper surface of the blade by the air flow through the louver and to form drip points in front of and below the upper extremities of the screw bosses.

9. A drainable blade louver according to claim 1 wherein each jamb includes a front vertical drainage channel registering with the ends of the top front troughs of the blades, an intermediate vertical drainage channel registering with the ends of the top intermediate troughs of the blades, and a rear vertical drainage channel registering with the bottom drainage troughs of the blades.

10. A drainable blade louver according to claim 9 wherein each blade includes a second rib portion intermediate the front and back edges and defining with a part of the base portion rearwardly of it a second intermediate drainage trough for capturing water and draining it toward the jambs, and wherein the intermediate drainage channels of the jams register with the second intermediate drainage troughs of the blades.

11. A drainable blade louver according to claim 9 wherein the drainage channels of each jamb are arranged symmetrically with respect to the axial centerline of the jamb so that the jambs may be reversed front to back and still be positioned in register with the blade drainage troughs.

12. A composite drainable blade louver comprising a front louver unit as claimed in claim 9 and a back louver unit as claimed in claim 9 placed front to back, wherein the drainage channels of each jamb are arranged symmetrically with respect to the axial centerline of the jamb, and wherein the jambs of the back louver are reversed front to back relative to the jams of the front louver.

13. A composite drainable blade louver according to claim 12 where the front flange portion of each blade of the back louver is shaped to match and mate with the rear flange portion of the front louver with the uppermost surfaces of the mating flange portions substantially flush.

* * * * *